United States Patent [19]

Allen

[11] Patent Number: 4,480,177

[45] Date of Patent: Oct. 30, 1984

[54] CURRENCY IDENTIFICATION METHOD

[76] Inventor: Milton F. Allen, 2989 McCully Dr., NE., Atlanta, Ga. 30345

[21] Appl. No.: 498,263

[22] Filed: May 26, 1983

Related U.S. Application Data

[63] Continuation of Ser. No. 235,532, Feb. 18, 1981.

[51] Int. Cl.[3] ..... G08B 15/02

[52] U.S. Cl. ..... 235/379; 235/468; 235/491; 109/25; 109/29; 283/74; 283/72

[58] Field of Search ..... 340/572, 568; 209/534; 382/7; 235/468, 382, 491, 379; 109/25, 29, 32; 283/57, 72, 74, 82, 84, 89, 101, 94, 95, 96, 97, 901; 234/46, 47; 428/206, 207, 208, 211, 916

[56] References Cited

U.S. PATENT DOCUMENTS

| | | | |
|---|---|---|---|
| 1,983,461 | 12/1934 | Howett | 299/90 |
| 3,272,533 | 9/1966 | Allen | 283/7 |
| 3,282,210 | 11/1966 | Weig | 101/426 |
| 3,564,525 | 2/1971 | Robeson et al. | 340/224 |
| 4,226,194 | 10/1980 | Grahn | 109/25 |
| 4,277,774 | 7/1981 | Fujii et al. | 340/146.3 Q |
| 4,325,196 | 4/1982 | Gauch et al. | 40/2.2 |
| 4,328,274 | 5/1982 | Tarbutton et al. | 428/149 |

*Primary Examiner*—Gene Z. Rubinson
*Attorney, Agent, or Firm*—B. J. Powell

[57] ABSTRACT

A method of treating paper money and the like for the purpose of identification by applying to one of the surfaces of the paper money a first treating material overcoating the first treating material with a layer of transparent material to prevent the first treating material from being removed from or obscured, and then applying a second treating material over the transparent material and the surface of the paper money where the first and second treating materials are normally invisible but rendered visible under ultra violet light. The method may also include providing means for detection of the paper money by touch, taste, smell or hearing. The invention also contemplates the article produced by the method.

12 Claims, 10 Drawing Figures

CURRENCY IDENTIFICATION METHOD

CROSS REFERENCE TO RELATED APPLICATION

This is a continuation of my co-pending application Ser. No. 235,532, filed Feb. 18, 1981.

BACKGROUND OF THE INVENTION

This invention relates generally to the identification of paper money and other similar documents and more particularly to such identification for purposes of detection and apprehension of criminals.

Various prior art techniques have been used to identify paper money and other documents illegally obtained. Most of these prior art techniques have used methods which try to directly identify the person having custody of the illegally obtained documents in such a manner that apprehension is facilitated. Typically, such prior art methods use a dye and/or tear gas bomb which is set to explode after the criminal leaves the bank or other institution at which the robbery takes place.

The basic problem encountered with these explosive methods is that the criminal may become aware of such identification prior to detection by law enforcement authorities. Because of this, the criminal thus has an opportunity to overcome such identification prior to apprehension by the law enforcement authorities. Also, these exploding techniques frequently endanger innocent persons in the vicinity of the criminal when the identification takes place.

Another prior art method uses an odor producing material which is released onto the illegally obtained documents during or after the robbery as the documents are handled. This material produces a detectable odor after the scene of the crime to assist in locating the documents; however, the detectable odor diminishes over time so as to eventually lose its effectiveness.

Also, these prior art techniques in and of themselves generally are not able to identify the source of the money or paper and thus must be related to their source using other means. Because the identification of the stolen goods is readily apparent to the criminal, the criminal generally is able to dispose of the identified goods so that detection of the goods through subsequent use by the criminal is not practically available.

Another prior art technique uses a normally invisible powder to coat the money or other paper but which can be made visible when exposed to ultra violet light. This powder rubs off on persons handling same so as to permit identification of the person possibly by exposure to ultra violet light. Because this powder is normally invisible, subsequent use of the thusly identified money is encouraged. Thus, detection through subsequent use is possible. One of the major problems associated with this prior art technique is that, because the powder is normally invisible, it is difficult to identify the money during subsequent use as having the powder thereon since it is not practical for all money to be exposed to ultra violet light. Thus, detection during subsequent use is generally not made. Also, this prior art technique generally is not able to identify the source of the money, even when detection is made, thereby making it especially difficult to obtain conviction of the criminal for the original criminal action.

SUMMARY OF THE INVENTION

These and other problems and disadvantages associated with the prior art are overcome by the invention disclosed herein by providing a technique for identifying money and other papers which encourages subsequent use thereof by the criminal but which can be detected during such subsequent use without the knowledge of the criminal. The invention also indentifies the source of the stolen goods thereby facilitating conviction of the criminal using same. The invention includes an initial identification that the currency is suspect which is discernible by trained personnel such as bank tellers without special aids but which is normally not discernible to other people such as the criminal. In addition, the invention also includes a normally invisible identification rendered visible by ultra violet light to identify the source of the goods. Thus, the trained personnel can easily initially identify the money during subsequent use without detection by the criminal and can then expose the money and/or person using the money to ultra violet light for further identification of the source of the goods as well as the persons handling the money. The invention thus provides a detection technique for paper currency that cannot readily be detected during a robbery or noticed by the robber at the scene of the crime to protect the bank teller or cashier or other innocent persons in the vicinity of the crime from any dangers caused if such detection could be made by the robber. The inconspicuous treatment techniques of the invention permit the bank or other business to safely post strong warnings that the facility is protected by detection techniques responsive to all fives senses—sight, touch, taste, smell and hearing—to provide a strong deterrent to a robbery taking place.

The invention includes source indicia applied to a piece of paper money or the like identifying the source from which it was obtained where the location indicia is normally invisible but is rendered visible upon exposure to ultra violet light, and a transparent layer of material applied over the indicia to prevent inadvertent removal or obscurity of the indicia. Also included is an initial indicia applied to the piece of paper money which is discernible but inconspicuous so as to be noticed only by trained personnel. The initial indicia may be in the form of a printed code applied to the money at a predetermined location as in the form of a layer of material applied to the money at a predetermined location and defining a textured surface thereon distinguishably different to the touch than the texture of the surfaces of the money. Additionally, a taste detection capability may be incorporated in the layer of material sensitive to touch by adding a taste distinctive ingredient such as salt or sugar to the layer of material. The taste detection serves as a confirmation that the currency is suspect.

The invention also includes secondary detection means to provide subsequent detection of the specially coded paper money in the event such money is not initially detected by the trained personnel. In embodiment, an inconspicuous layer of material is added to one surface of the piece of paper money so that it is rejected by counting equipment to bring it to the attention of the equipment operator. In another embodiment, one surface of the paper money is provided with inconspicuous permanent magnet tabs to cause the money to be magnetically attracted to the spring clip in cash drawers and be lifted thereby so as to bring it to the attention of the bank teller or cashier.

These and other features and advantages of the invention disclosed herein will become more apparent upon consideration of the following description and accompanying drawings wherein like characters of reference designate corresponding parts throughout the several views and in which:

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Figure 1:
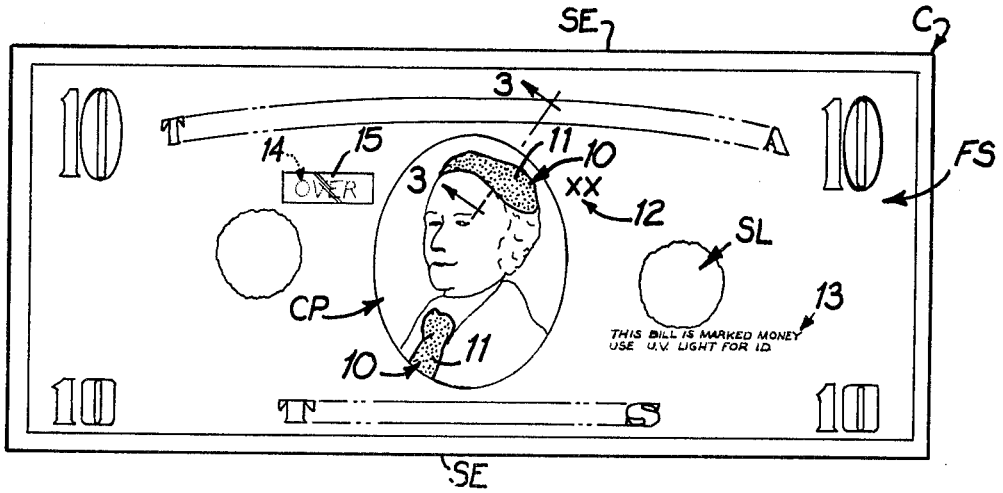
FIG. 1 is a schematic plan view of the front surface of a ten dollar bill incorporating the invention thereon.
Figure 2:
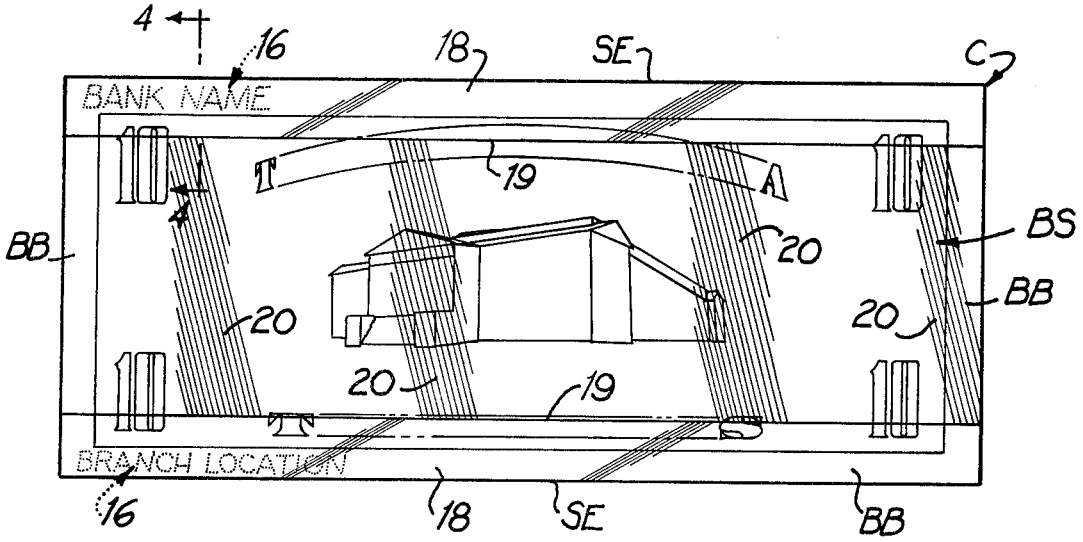
FIG. 2 is a schematic plan view of the rear surface of a ten dollar bill incorporating the invention thereon.
Figure 3:
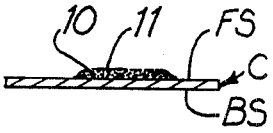
FIG. 3 is an enlarged cross-sectional view taken generally along line 3—3 in FIG. 1.

A first embodiment of the invention is illustrated in FIGS. 1-4. FIG. 1 schematically illustrates the front surface FS of a piece of currency C with a ten dollar denomination while FIG. 2 illustrates the back surface BS thereof. It is to be understood that the invention can be used with currency of any denomination or with any article of value such as negotiable instruments or packages containing valuables such as jewelry and the like. The front surface FS of U.S. currency has a central portrait CP thereon seen in FIG. 1, as well as other identifying numbers and letters. The back surface BS has a blank border BB therearound as seen in FIG. 2. When handling currency, bank tellers generally hold the currency so that their thumb or fingers engage the front surface FS of the currency on the central portrait CP and they feel the currency adjacent the side edges SE thereof while handling. The first embodiment of the invention makes use of these actions by bank tellers to initially identify the currency as having a special treatment for coding and is probably currency illegally obtained.

Figure 4:
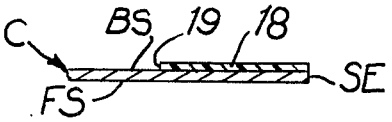
FIG. 4 is an enlarged cross-sectional view taken generally along line 4—4 in FIG. 2.

As seen in FIGS. 1 and 4, certain areas of the central portrait CP are provided with a layer 10 of material having a roughened surface 11 thereon. There are two such layers 10 illustrated in FIG. 1, one incorporated in the hair and one incorporated in the tie of the person in the portrait CP. The particular areas to which the layers 10 are applied are selected so that the layers 10 are difficult to detect visually so that the person in illegal possession of the currency will not normally identify the currency as being specially coded for identification. As bank tellers handle the currency, however, they will feel the roughened surface 11 on at least one of the layers 10 and thus be able to easily identify that currency as being specially coded.

The layer 10 is formed with an adhesive which is applied in a thin layer as a liquid and dries to transparency or to a color which blends with the area of the portrait to which it is applied. The roughened surface 11 is provided by mixing a gritty material of a blending color with the adhesive before it is applied, or applied to the adhesive after the thin layer is applied but before the adhesive dries. Any gritty material may be used such as appropriately colored sand and the like. A number of commercially available adhesives such as that sold under the tradename "Elmer's" by Borden and that sold under the tradename "Duco" by DuPont. Preferably, the adhesive is flexible in its dried or cured state to permit the layer 10 to flex as the currency is flexed.

The layer 10 may also be made responsive to taste by using salt, sugar or the like for the gritty material in layer 10. This permits taste to be used to further identify the currency as having been specially coded.

It will also be appreciated that bank tellers normally look at each piece of currency they are handling in the vicinity of the central portrait CP. To visually notify the bank tellers that the currency has special coding thereon, a visible marking 12 is printed on the currency in the vicinity of the central portrait CP. The marking 12 is illustrated in FIG. 1 as an "XX"; however, different markings may be used. It is important that the size and style of the marking 12 be inconspicuous to persons except those having special knowledge of the significance thereof. For instance, the marking 12 illustrated would have a size and style corresponding to the numbers or letters in the normal printing on the currency in the vicinity of the marking 12. The bank tellers would be informed that the marking 12 identifies the currency as having been specially coded. However, the general public would not be so informed and would, therefore, not apply any significance to the marking 12 even if it was noted since the marking 12 would simply appear to be part of the printing normally found on the currency.

An additional visible marking 13 is also illustrated in FIG. 1 adjacent one of the seals SL normally printed on the currency. The visible marking 13 is illustrated as "This bill is marked money—use U.V. light for I.D."; however, different such markings may be used. The size and style of marking 13 is such that it blends with the printing on the currency to insure that it will be inconspicuous to persons except those specially trained to take note thereof. While the marking 13 is readily distinguishable on the schematic rendering of the current C, it will be appreciated that the additional printing actually on the currency but omitted in FIG. 1 would render such marking 13 inconspicuous.

Once the bank teller has been notified that the currency has a special coding by seeing the marking 12 and/or feeling the layer 10, the bank teller will be trained to expose the currency to ultra violet light as will become more apparent for further identification. It is further to be understood that additional visible markings 12 inconspicuously located on the front surface FS of the currency may be used for instructions to the bank teller to expose the currency to ultra violet light.

To assist in instructing the bank teller where the special coding is located on the currency, an instructional code 14 is provided on the front face of the currency. The instructional code 14 is written with a material which is normally invisible but becomes visible when exposed to ultra violet light. Such materials are commercially available in invisible ink pens so that the code 14 can be written. The instructional code 14 is illustrated as the word "over" but may be any convenient instructional message. It will be appreciated that the instructional code 14 would normally be invisible and is illustrated as dotted lines in FIG. 1 simply for understanding. Because the material used for the instructional code 14 can be partly removed or smeared during handling, a transparent protective layer 15 is applied over code 14. The protective layer 15 may be any transparent material which adheres to the front surface FS of the currency. One practical material for this use is transparent tape commercially available under the tradename "Scotch" from the 3M company in St. Paul, Minnesota. This transparent tape has an adhesive applied thereto for use in attaching the tape to the currency. Thus, the bank teller notes the instructional code 14 upon exposure of the front surface of the currency to ultra violet light and turns the currency over to expose the back surface BS to ultra violet light for further identification.

The back surface BS of the currency as seen in FIG. 2 has source codes 16 located in the blank border BB therearound. The source codes 16 provide sufficient information to identify the source from which the currency was obtained illegally. For instance, one of the source codes 16 identifies the bank name while the other code 16 identifies the bank location. Different information may, of course, be used for codes 16. The codes 16, like code 14, are written with a material which is normally invisible but becomes visible when exposed to ultra violet light. Codes 16 would, of course, be normally invisible and are shown as dotted lines for understanding.

To protect codes 16, a transparent protective layer 18 is applied over each as seen in FIGS. 2 and 4. The transparent protective layers 18 are similar to layer 15 and are illustrated at extending along each of the side edges SE of the back surface BS of the currency. The layers 18 are illustrated as transparent tape so that the inboard edges 19 of the layers 18 are perceptible to feel as the bank teller handles same. This assists the bank teller in initially identifying the currency as having a special coding thereon. Preferably, the layers 18 have a smooth non-absorbing surface thereon as will become more apparent.

The back surface BS of the currency may also be overcoated with a normally invisible coating indicated by the diagonal shading 20. This coating is rendered visible upon exposure to ultra violet light as are the codes 14 and 16 and is typically of the same material as that of codes 14 and 16 in powder form. Coating 20 is left uncovered so part of it will rub off on the skin and clothing of the person handling same to permit identification of such persons upon exposure to ultra violet light. Because the surfaces of the layers 18 are smooth and nonabsorbing, the coating 20 will not adhere nor impregnate layers 18. Thus, the coating 20 will not obscure the codes 16 so that they can be easily read or any coating 20 which inadvertently gets on the surfaces of the layers 18 can be easily wiped off when it is desired that codes 16 be read. Preferably, the material used for codes 16 should have a different color under ultra violet light than the material in coating 20 to further enhance legibility of codes 16.

It will thus be seen that, when bank tellers see the visible marking 12 or feel the roughened surfaces 11 on layers 10 or feel the protective layers 18 while they are handling the currency, they are initially notified that the currency may be specially coded and they need to examine the currency under ultra violet light. They then expose the currency to ultra violet light to make codes 14 and 16 visible and to make coating 20 visible. This provides information to the receiving bank and law enforcement personnel to provide information to assist in determining the identification of the persons who have obtained possession of the currency illegally without the person using the currency being able to readily detect that such currency is specially coded.

When paper currency is counted in counting equipment, such equipment typically checks each piece of currency for density, weight and thickness. It is desirable to have such equipment reject any specially coded currency so as to put the equipment operator on notice that such currency is abnormal and, therefore, encourage the operator to further check such rejected currency for special coding. Thus, even if such specially coded currency inadvertently escapes the attention of the receiving bank teller, it will subsequently be brought to the attention of the equipment operator to increase the likelihood of the currency being detected.

Figure 5:
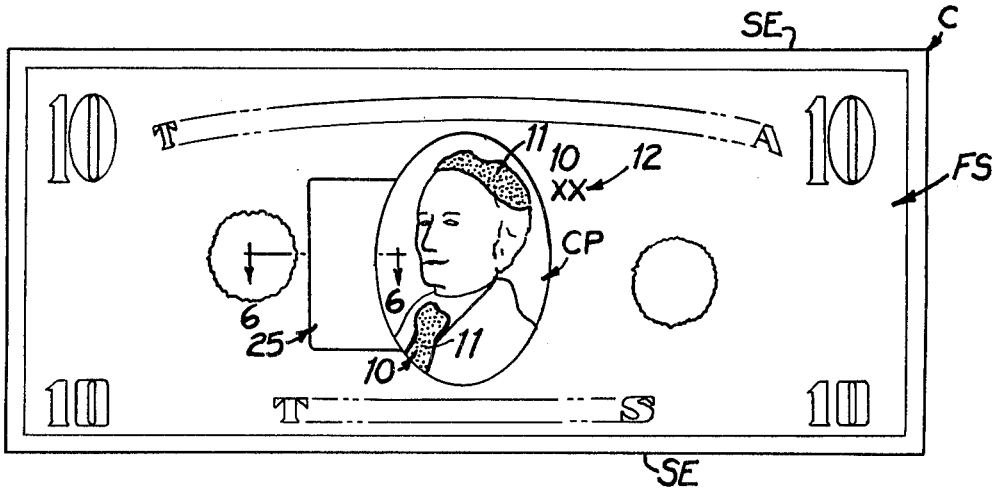
FIG. 5 is a schematic plan view of the front surface of a ten dollar bill incorporating a second embodiment of the invention thereon.
Figure 6:
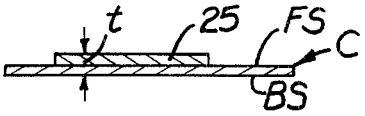
FIG. 6 is an enlarged cross-sectional view taken along line 6—6 in FIG. 5.

FIGS. 5 and 6 illustrate a piece of currency which has been equipped with means for causing the rejection thereof by paper currency counting equipment. In addition to the layers 10 and visible marking 12, as seen in FIG. 1, the piece of currency C in FIG. 5 has applied to the front surface FS thereof a detection layer 25 adjacent the central portrait CP. The detection layer 25 has a color which blends with the colors normally on the front surface of the currency so as to be visually inconspicuous. As best seen in FIG. 6, the layer 25 has a thickness t such that the combined thicknesses of the currency C and detection layer 25 is greater than the thickness acceptance range of the currency counting equipment. Also, the layer 25 has a size such that it will be operatively associated with the thickness detection system of such equipment. As a result, the counting equipment will detect and reject the piece of currency to encourage further investigation by the equipment operator.

The detection layer 25 may also have an opacity greater than that acceptable by the density sensing means in the currency counting equipment with the size of layer 25 being such that the layer 25 will be operatively associated with the density sensing means in the counting equipment. This will further cause the currency counting equipment to reject the piece of currency to encourage further investigation by the equipment operator.

The operator would further investigate the currency by exposing it to ultra violet light. When the back surface BS is exposed to the ultra violet light, the source codes 16 and coating 20 would become visible to inform the operator and assist in tracing back the currency to the persons who have obtained illegal possession thereof.

The detection layer 25 may be made out of paper, plastic or other similar material bonded to the front surface FS of the currency. Preferably, the layer 25 should have about the same flexibility as the currency to prevent detection thereof by persons having possession thereof without special knowledge as to the significance of layer 25.

Figure 7:
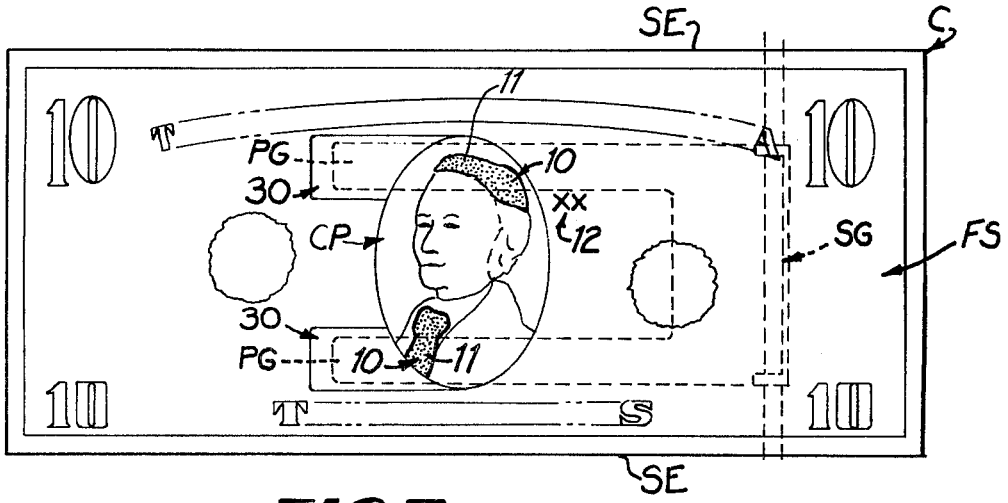
FIG. 7 is a schematic plan view of the front surface of a ten dollar bill incorporating a third embodiment of the invention thereon.

It is also desirable to provide a back-up method of notifying the bank teller or cashier that the currency needs to be further examined even if the teller or cashier initially fails to detect that such currency has a special coding. FIG. 7 illustrates one such back-up method which utilizes the ferromagnetic spring clip SG normally found in cash drawers to hold the currency in position within the drawer. The spring clip SG is shown in dashed lines in FIG. 7 and the cash drawer itself is omitted for clarity.

The currency C shown in FIG. 7, in addition to the layers 10 and visible marking 12 shown in FIG. 1, has a pair of spaced apart permanent magnet tabs 30 applied to the front surface FS thereof at locations such that the hold down prongs PG on the spring clip SG engage tabs 30. This causes the tabs 30 to be magnetically attracted to the prongs PG so that, when the spring clip is pivoted upwardly, the currency C will be raised therewith. This gives the teller or cashier another opportunity to visually note the unusual behavior of the currency C as it rises with the spring clip to encourage further investigation as to the special coding thereon as described hereinabove.

The tabs 30 may be made out of a flexible permanent magnet material so as to reduce detection by the uninformed user and should be as thin as possible. Such material is commercially available under the tradename "Plastiform" from the 3M Company of St. Paul, Minn. The tabs 30 would, of course, be colored to blend with the coloring on the front face FS of the currency C.

Figure 8:
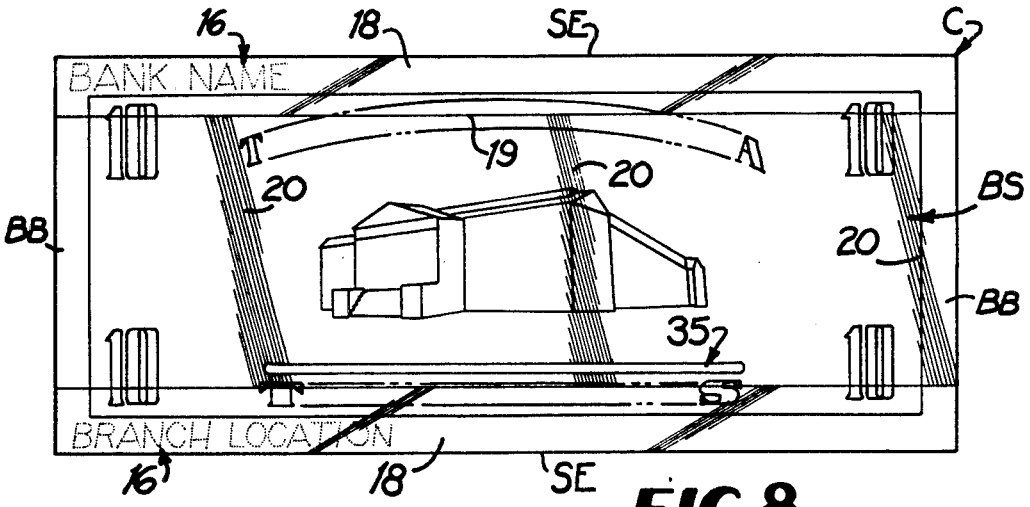
FIG. 8 is a schematic plan view of the back surface of a ten dollar bill incorporating a fourth embodiment of the invention thereon.

In some instances, it may be desirable to also provide additional detection methods for assisting law enforcement personnel in locating the currency. FIG. 8 illustrates the use of an odor-producing material which will vaporize the produce a distinct odor to assist in detection. The odor-producing material is confined in a closed frangible vial 35 as seen in FIG. 8 secured to the back surface BS of the piece of currency C. The currency C with vial 35 thereon would be kept in a special location within the cash drawer of a bank teller or cashier and would be included in the currency received during a robbery. The handling of the currency C with vial 35 prior to the robbery would be done in a sufficiently cautious manner so as not to break the vial 35. During the robbery, however, the normal handling by the teller or cashier would typically fracture the vial 35 either intentionally or unintentionally to start the release of the odor producing material. Even if the vial 35 was not broken during this transfer, the robber would most probably fracture same during this subsequent handling. The vial 35 and odor producing material should have a color which blends with the currency so as to be inconspicuous and hence not normally detectable by the robber.

The vial 35 is typically made out of a readily fracturable material such as glass or brittle plastic to insure its intentional or accidental fracture as it is handled. The odor producing material may be a variety of substances such as diacetyl, ethyl mercaptan, diethyl sulfide, octyl aldehyde or phenyl oxide. A small percentage of oil may be added thereto to prolong the odor producing effectiveness of these substances. The odor from the odor producing material is typically not noticeable unless the treated currency is in a confined space such as a room, auto, clothing or average residence. While in the confined space, the vapors from the odor producing material will permeate the confining space and be readily recognizable for an appreciable time so that the law enforcement personnel is able to readily identify the currency by smell to assist in apprehending the criminal as they search the confining space. Thus, even though the criminal may have disposed of the thusly treated currency, he can still be identified by the odor remaining in the confined space.

As will be noted in FIG. 8, the vial 35 containing the odor producing material is added to the back surface BS of currency C in addition to the source codes 16, transparent layers 18 and coating 20. Thus, when the law enforcement personnel locates the currency by smell, the source from which the currency was obtained can be easily determined by the use of ultra violet light.

Figure 9:
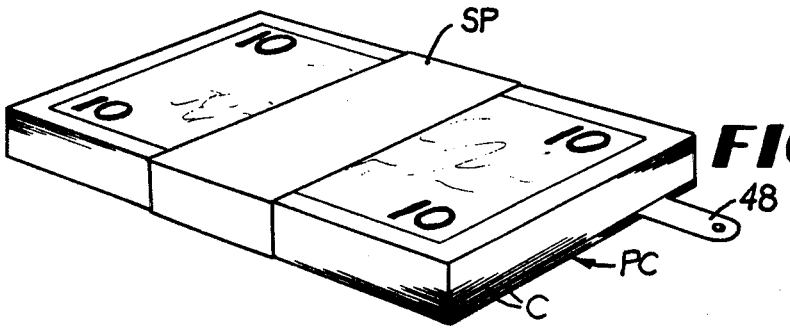
FIG. 9 is a perspective view of a packet of bills incorporating a fifth embodiment of the invention therein.
Figure 10:
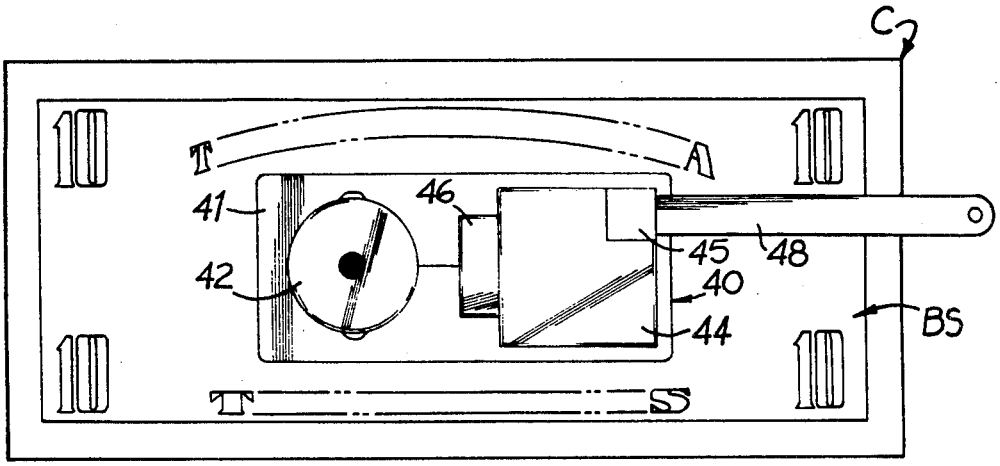
FIG. 10 is a schematic plan view of the back surface of one of the bills from the packet of bills in FIG. 9.

It will also be appreciated that the specially coded currency C may be incorporated in a packet of bills PC as seen in FIG. 9 where packet PC is enclosed in a strap SP so that packet PC has all of the appearance of a standard packet of bills so as to be indistinguishable from the normal packets of currency received during a robbery. To assist law enforcement personnel in locating the packet PC during searches, an audible sound generating mechanism 40 may be concealed in packet PC. FIG. 10 illustrates the sound generating mechanism 40 attached to the back surface BS of a piece of currency C that is included in packet PC.

The sound generating mechanism 40 has the capability of generating an audible alarm signal to facilitate law enforcement personnel in locating the packet of bills PC after a robbery has taken place. The mechanism 40 is sufficiently thin to maintain the packet of bills PC at about the same thickness of a standard packet of bills.

While a variety of constructions may be used for mechanism 40, the mechanism 40 seen in FIG. 10 includes a base 41 on which is mounted a miniature buzzer 42. The buzzer 42 is powered by a battery pack 44 on base 41 connected to the buzzer 42 through a switch 45 and a time delay network 46. The switch 45 has an actuator tab 48 such that the switch 45 disconnects the battery pack 44 from the time delay network 46 and buzzer 42 while the tab 48 is positioned in switch 45 as seen in FIG. 10 and connects the battery pack 44 to the time delay network 46 and buzzer 42 when the actuator tab 48 is pulled out of switch 45 to start the operation of the sound generating mechanism 40. Thus, the tab 48 is left in switch 45 while the packet of bills PC is being stored in the cash drawer or other depository prior to a robbery to prevent operation of the mechanism 40. That end of the actuator tab 48 projecting out of the packet of bills PC as seen in FIG. 9 is attached to the cash drawer or depository so that, when the packet PC is withdrawn during a robbery, the tab 48 will automatically be removed from switch 45 to start operation of the sound generating mechanism 40. It is likewise understood that other types of switches which are mechanically or magnetically actuated may be substituted for switch 45.

The time delay network 46 serves to delay the generation of the audible alarm signal until the robber has an opportunity to leave the premises being robbed. Once the switch 45 has been actuated by the removal of tab 48, power from battery pack 44 is supplied to network 46. When network 46 times out after a prescribed period of time usually 2–30 minutes, it connects the battery pack 44 to buzzer 42 to cause continuous generation of the audible alarm signal. This gives the robber time to leave the scene of the robbery so as not to create a danger to innocent persons at the scene of the crime.

Even if the robber is able to locate and dispose of the packet PC, it cannot be disabled since the actuator tab 48 remains at the scene of the crime. Therefore, the audible alarm signal continues to assist law enforcement in locating packet PC and tracing the escape route of the criminal.

The sound generating mechanism 40 is illustrated attached to the back surface BS of a piece of currency C which does not have the special coding described hereinabove thereon. Other currency C with the special coding thereon would, of course, be included in the packet PC. Further, it will be appreciated that the sound generating mechanism 40 may be attached to currency with the special coding thereon.

What is claimed as invention is:

1. A method of treating paper money with opposed surfaces and a central portrait printed on one of the surfaces for the purpose of identifying same comprising the steps of:

applying to that surface of the paper money opposite the surface on which the central portrait is printed a first treating material to form a source identifying code thereon where said first treating material is normally invisible but is rendered visible under ultra violet light; and applying a mixture of liquid adhesive and gritty material over a portion of the central portrait, and allowing the mixture to dry to form a layer defining a textured surface thereon distinguishable by feel from that of the surface of the paper money to aid in the detection of the paper money during the handling thereof by bank personnel.

2. The method of claim 1 wherein the step of applying the mixture further includes applying the mixture over that portion of the central portrait depicting the hair of the person shown in the portrait.

3. The method of claim 1 further comprising the step of applying a layer of material to one surface of the paper money having a thickness such that the combined thickness of the layer of material and the paper money is greater than the thickness acceptance range of automatic paper money counting equipment so that the paper money will be rejected thereby, said layer of material constructed and arranged so as to inconspicuously blend with the face of paper money.

4. The method of claim 1 further comprising the step of applying at least one piece of permanent magnet material to one surface of the paper money where the piece of permanent magnet material is constructed and arranged so as to inconspicuously blend with the surface of the paper money and to be magnetically attracted to the spring clip in a cash drawer to become conspicuous when the spring clip is raised.

5. The method of claim 1 further comprising the step of affixing a frangible container containing an older producing material therein to the surface of the paper money so that the frangible container will be broken during handling of the paper money to slowly and safety release the odor producing material where the odor producing material vaporizes over a period of time to produce a distinctive odor readily distinguishable when the paper money is stored in a relatively enclosed space.

6. The method of claim 1 further comprising the steps of affixing an audible sound generating mechanism to the surface of the paper money where the sound generating mechanism includes activation means and is constructed and arranged to generate an audible sound signal starting a prescribed period of time after actuation of said activation means to assist in locating the paper money; arranging the paper currency with other pieces of paper currency to form a packet where the sound generating mechanism is concealed within the packet; and enclosing the packet in a strap to maintain the integrity of the packet.

7. A piece of paper money having opposed surfaces and a central portrait printed on one of the surfaces; having applied to that surface opposite said portrait a first treating material arranged to form a source identifying code thereon, said first treating material being normally invisible but becoming visible under ultraviolet light; and having bonded to a portion of the central portrait a cured layer comprising a mixture of adhesive and gritty material, said cured layer defining a textured surface thereon distinguishable by feel from that of the surface of the paper money.

8. The piece of paper money of claim 7 wherein said gritty material is sand.

9. The piece of paper money of claim 7 wherein said gritty material is salt.

10. The piece of paper money of claim 7 wherein said gritty material is sugar.

11. The piece of paper money of claim 7 wherein said cured layer has a color corresponding to that portion of the central portrait over which said layer is applied.

12. Encoded currency for use in identifying unauthorized persons having same comprising:

a piece of paper currency defining a pair of opposed surfaces thereon;

a first treating material applied to portions of one of said surfaces, said first treating material being normally invisible but becoming visible while ultraviolet light is shining thereon, said first treating material arranged on said surface to form a source identifying code when visible;

a second treating material applied to said one of said surfaces, said second treating material also normally invisible but becoming visible while ultraviolet light is shining thereon, said second treating material being capable of rubbing off of said surface onto the skin and clothing of persons handling same to assist in identifying same; and a layer of textured material applied to portions of the other of said surfaces and defining a textured roughened surface thereon distinguishable by feel from that of said surfaces of said piece of currency.

* * * * *